United States Patent [19]

Tilliette

[11] Patent Number: 4,633,819

[45] Date of Patent: Jan. 6, 1987

[54] WATER-SODIUM STEAM GENERATOR WITH STRAIGHT CONCENTRIC TUBES AND GAS CIRCULATING IN THE ANNULAR SPACE

[75] Inventor: Zéphyr Tilliette, Clamart, France

[73] Assignee: Commissariat a l'Energie Atomique, Paris, France

[21] Appl. No.: 833,588

[22] Filed: Feb. 27, 1986

Related U.S. Application Data

[63] Continuation of Ser. No. 680,467, Dec. 11, 1984, abandoned.

[30] Foreign Application Priority Data

Dec. 21, 1983 [FR] France ..... 83 20469

[51] Int. Cl.[4] ..... F22B 1/16

[52] U.S. Cl. ..... 122/32; 165/158; 165/142; 122/33

[58] Field of Search ..... 122/32, 33; 165/83, 165/158, 142

[56] References Cited

U.S. PATENT DOCUMENTS

| | | | |
|---|---|---|---|
| 2,853,277 | 9/1958 | Boni | 257/231 |
| 3,690,839 | 9/1972 | Jones | 165/158 |
| 3,741,164 | 6/1973 | Barratt | 122/32 |
| 3,768,554 | 10/1973 | Stahl | 165/158 |
| 3,850,231 | 11/1974 | Creek | 122/32 |
| 3,939,804 | 2/1976 | Barratt | 122/32 |
| 4,098,329 | 7/1978 | Culver | 122/32 |
| 4,198,929 | 4/1980 | Forestier et al. | 165/158 |
| 4,257,356 | 3/1981 | Minnick | 122/32 |
| 4,377,552 | 3/1983 | Doublet et al. | 165/83 |
| 4,446,820 | 5/1984 | Jansing et al. | 122/32 |
| 4,488,513 | 12/1984 | Jahnke et al. | 122/32 |

FOREIGN PATENT DOCUMENTS 1501741 11/1967 France .

*Primary Examiner*—Henry C. Yuen

[57] ABSTRACT

A steam generator installation comprises an envelope, first and second tube plates defining an intermediate fluid discharge chamber; a bundle of external tubes connected to the tube plate, an internal tube being arranged within each external tube, a liquid metal circulating outside the external tube, an admission chamber for the water, which is introduced into the internal tubes, a discharge chamber for the steam and an admission chamber for the intermediate fluid. This fluid circulates between the internal tubes and the external tubes. The intermediate fluid discharge chamber is connected to the inlet of a heat exchanger, which cools it. The intermediate fluid admission chamber is connected to the outlet of this exchanger.

10 Claims, 6 Drawing Figures

Figure 1:
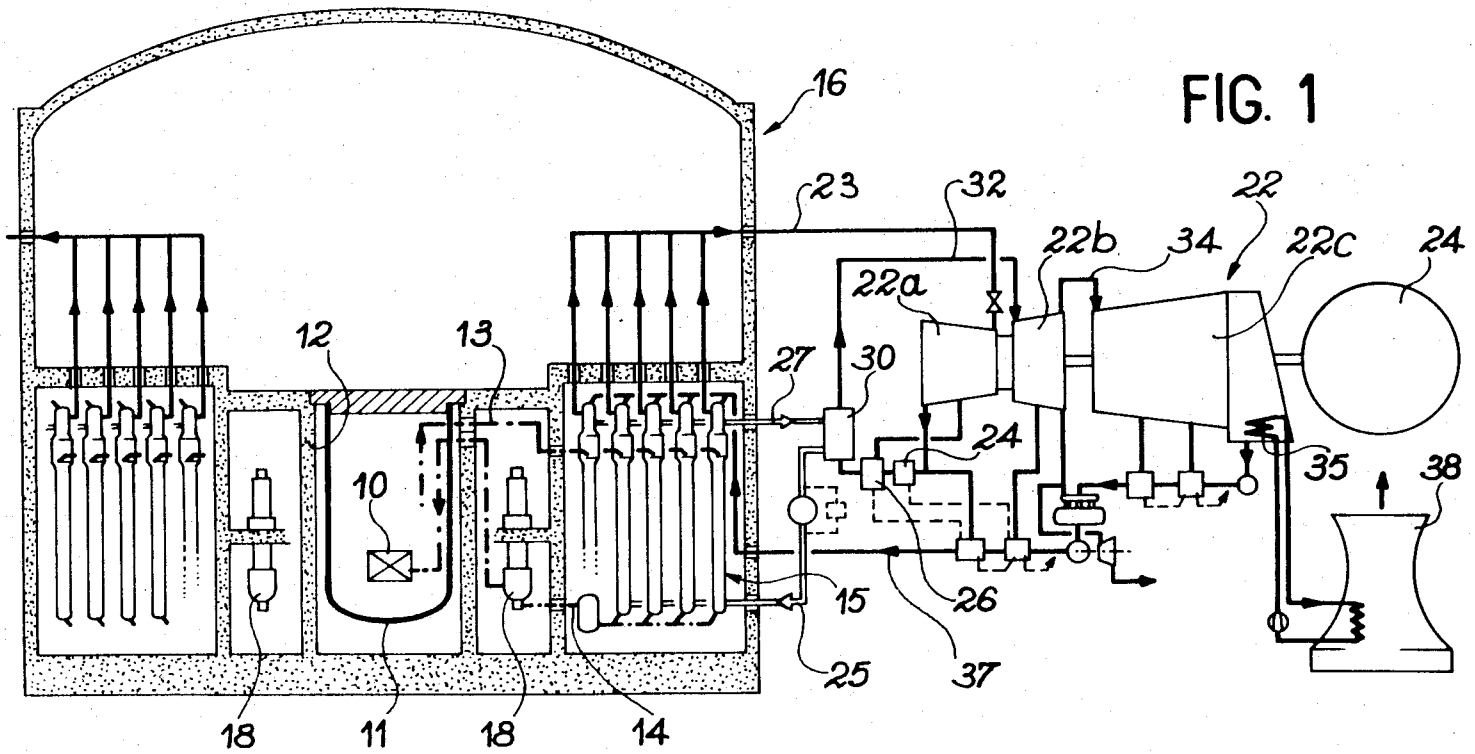

$H_2O$
37
133
135
130
133a
42a
136
$H_2O$
52
70
He
50
62
Na
13
42b
40
72
42b
134a
134
42c
He
Na
14
40b

WATER-SODIUM STEAM GENERATOR WITH STRAIGHT CONCENTRIC TUBES AND GAS CIRCULATING IN THE ANNULAR SPACE

This application is a continuation of application Ser. No. 680,467, filed Dec. 11, 1984, abandoned.

The invention relates to a steam generator for the indirect transfer of heat between a first fluid constituted by a liquid metal and a second fluid constituted by water, by means of an intermediate fluid, the steam generator comprising:

an envelope having a longitudinal axis, said envelope having a heat exchange area between the first and second fluids and first and second inlet/outlet areas for these fluids, the first and second areas being located on either side of the exchange area;

a bundle of tubes called "external tubes" connected to the first tube plate, a tube called the "internal tube" being arranged in each external tube and coaxially thereof, one end of each internal tube being connected to the second tube plate;

an inlet and an outlet being provided in the envelope for the liquid metal, which circulates outside the external tubes;

at least one water admission chamber, the water being introduced into the internal tubes;

at least one discharge chamber for the steam;

at least one admission chamber for the intermediate fluid, which is present between the external and internal tubes;

at least one discharge chamber for the intermediate fluid.

A sodium-water heat exchanger of this type is already known (FR-A-1,501,741). In this exchanger, the liquid metal and the water are separated from one another by a space containing the intermediate heat transfer fluid.

The exchanger comprises a cylindrical shaft or drum 30, which is closed at each of its ends by a thick tube plate 22,25. A convex base 41, 42 is joined to each tube plate. Intermediate tube plates 31, 32 are arranged in the drum 30 between plates 22, 25. A bundle of double-walled straight tubes extends between plates 31, 32. The liquid metal, for example sodium, circulates externally of the bundle of double-walled tubes. Tube plate 31 and plate 22 define an intake chamber for the intermediate fluid. Tube plate 32 and tube plate 25 define a discharge chamber for this intermediate fluid. An intake connection 35 in the admission chamber is fixed to the drum. A discharge connection 36 for removing the intermediate fluid from the discharge chamber is fixed to the same drum. The intake connection 35 is connected to the heat transfer fluid reservoir forming a static barrier filling the interior of envelope parts 33, 34, as well as the space between external tubes 49 and internal tubes 46. The intake connection 35 can be used for adjusting the volume of the intermediate fluid. The discharge connection 36 is connected to an appropriate emptying means. The transfer fluid can be a liquid metal, e.g. sodium or a mixture of sodium and potassium, lead, bismuth, lithium or a lead and bismuth eutectic.

However, in an exchanger of this type, the intermediate fluid is static. The heat exchangers by convection virtually do not exist, so that heat exchange essentially takes place by conduction and it is necessary for the intermediate fluid to have a very good thermal conductivity. Therefore, the intermediate fluid is necessarily a liquid and preferably a liquid metal.

The present invention relates to a steam generator of the liquid metal-water type having a dynamic intermediate fluid, a gas instead of a liquid.

More specifically, the steam generator according to the invention is characterized in that the intermediate fluid circulates between the internal tubes and the external tubes, the discharge chamber for the intermediate fluid being connected to the inlet of a first heat exchanger associated with said generator, the admission chamber of the intermediate fluid being connected to the outlet of the same exchanger. The steam generator is also characterized in that the intermediate fluid is a gas (or a gaseous mixture), which is under pressure and chemically neutral, such as helium, which effectively separates the sodium from the steam/water, and in that said gas actively circulates and thus ensures heat transfers by convection.

The invention has numerous advantages. Firstly, with regards to the major part of the exchanged thermal power, the generator according to the invention makes it unnecessary to have recourse to an intermediate sodium-sodium circuit. Thus, this leads to a considerable simplification of the nuclear installation. Moreover, it satisfactorily solves the main difficulty encountered in the construction of a steam generator of this type, namely the effective separation of the sodium and the water. Thus, it is known that the water and the sodium react violently with one another, so that it is necessary to ensure that they do not mix. The presence of a chemically pure, pressurized intermediate gas between the water and the sodium constitutes an effective barrier. The gas does not lead to a considerable reinforcement of the tube containing the same. Moreover, the pressure of the intermediate gas is close to the mean value between that of the sodium and that of the steam, so that there is an advantageous staging for the satisfactory utilization of the structures and materials. Evan a significant steam/water leak will be reduced and entrained into the helium circuit, which is naturally equipped with a conventional water elimination device. In the exceptional case of a simultaneous leak on the helium tube and on the corresponding steam/water tube, the dilution of said steam/water in the helium subject to an intense circulation will be such that the effects on the sodium will be greatly reduced.

The determining factor in the heat transfer is the convection of the intermediate fluid circulating in the annular space. The heat transfer coefficient through said double wall can be compared favourably with that of steam generators having prestressed, double-walled tubes (Westinghouse, General Electric). For example, a prestressed tube generator is described in the Journal "Nuclear Technology, Vol. 55, November 1981". However, the circulation of the intermediate gas involves an external heat exchange, because this gas removes 6 to 7% of the total heat output. This energy is effectively used as a heating supplement for the steam cycle and more specifically for the resuperheating of the moderate or mean pressure steam following high pressure expansion.

Moreover, the steam generator according to the invention makes it possible to trap leaks on the helium circuit and even its operation with moderate leaks. This concept of a small external loop permits better power control possibilities and better operating conditions with partial loading of the reactor.

The "small" intermediate gas circulation circuit has variable speed blowers acting on the flow rate, pressure varying means and control bypasses, which is conventional in the case of such circuits. It can therefore be adapted to any operating level and in this way flexible action means are available which are complementary to those existing on the one hand on the primary sodium circuit and on the other on the water-steam circuit.

The improvement to the operating conditions under partial loading more particularly relates to mean pressure resuperheating (resuperheater and high pressure turbine intake). In the conventional case of resuperheating by drawing off pressure, the temperatures drop as the load decreases. According to the invention, the resuperheated high pressure steam is maintained at a roughly constant temperature by the helium, which prevents thermal transients and involves a smaller reduction to the thermodynamic efficiency of the steam cycle.

The mechanical and thermal stresses are significantly reduced both on a continuous basis (high pressure steam at 12–14 MPa/400° C. approx. instead of 19 MPa/490° C.) and under transient conditions (reduced thermal efficiency of the gas).

The bundle of tubes can be formed from tubes of standard manufacture and tolerance. This represents a significant advantage compared with double-walled tubes mechanically connected by prestressing requiring special tolerances, i.e. much more expensive tubes. The materials used are of a standard, known nature, particularly with respect to the internal water/stream tube for which creep is not to be feared at its operating temperature of approximately 400° C.

According to a first embodiment, the steam generator has four tube plates arranged in pairs on either side of the heat exchange area. Thus, in the upper part of the generator, there are first and second plates and in the lower part, third and fourth plates. The intermediate fluid admission chamber is defined by third and fourth tube plates, whilst the intermediate fluid discharge chamber is defined by first and second tubes plates. The external tubes are connected to the first and third tube plates and the internal tubes to the second and fourth tube plates. An intermediate fluid supply pipe is connected to the envelope in the admission chamber and a discharge pipe is connected to the envelope in the discharge chamber.

According to a second embodiment, the steam generator comprises:

a tube plate called the "fifth tube plate", which has a larger axial spacing from the exchange area than the second tube plate, the fifth tube plate and the second tube plate defining a steam discharge chamber;

a first and a second tube are arranged within each internal tube, the first tube being positioned within the second tube, one end of the first tube being connected to a small tube plate, which is integral with a water tank, one end of each second tube being connected to the fifth tube plate, the second end of the first and second tubes being sealingly connected in such a way as to define an annular chamber containing a gas, which can be air;

each internal tube is closed at its lower end;

each external tube is connected to a small tube plate, which is integral with a helium tank.

Such a steam generator permits a better adjutment between the circulation and heat exchange conditions with respect to the steam/water and the helium, the intermediate fluid on the one hand and the intermediate fluid and the liquid metal on the other. It permits a better adaptation of the diameters of the water/steam and the helium jets. Moreover, it makes it possible to reduce the exchange length by increasing the diameters of the sodium-helium and helium-water tubes. In a variant, blades are provided in the annular space in which the intermediate fluid circulates, which makes it possible to further reduce the exchange length.

Finally, and this is a very important point, each of the internal tubes can expand freely and individually as in the first embodiment, but particularly in this configuration, each intermediate sodium-gas external tube can also expand freely and individually. This feature improves the operational and mechanical reliability of the steam generator.

The possibilities of access to the ends of the water and helium supply tubes are improved as a result of the presence of lateral helium and water tanks (fitting of diaphragms or sealing of leaking tubes).

The invention is described in greater detail hereinafter relative to the attached drawings, wherein show:

FIG. 1 a diagrammatic overall view of an installation for the production of electricity by means of a nuclear reactor using a steam generator constructed according to the invention.

Figure 2:
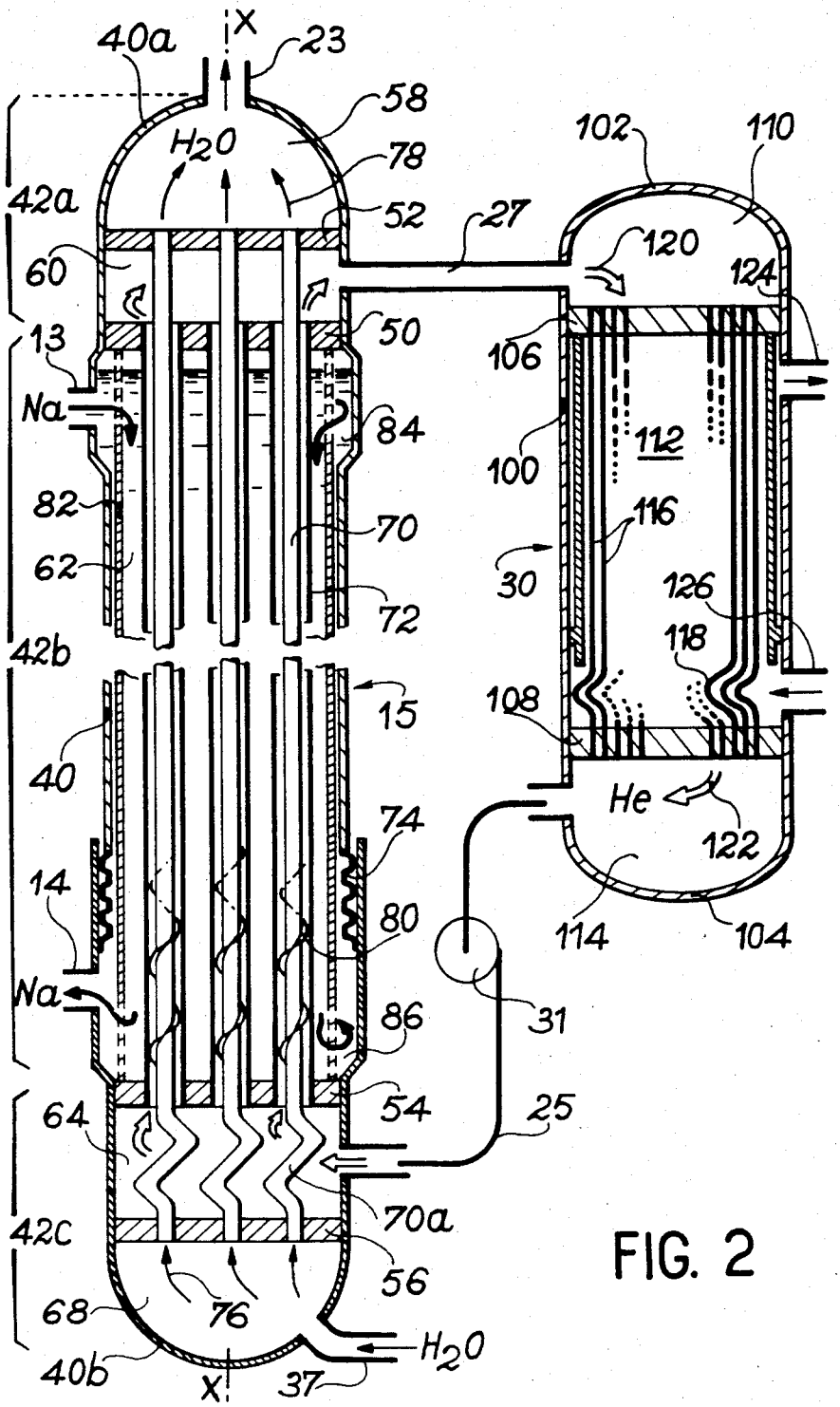

FIG. 2 a diagrammatic sectional view of a first embodiment of a steam generator according to the invention shown with a heat exchanger for the cooling of the intermediate fluid.

Figure 3:
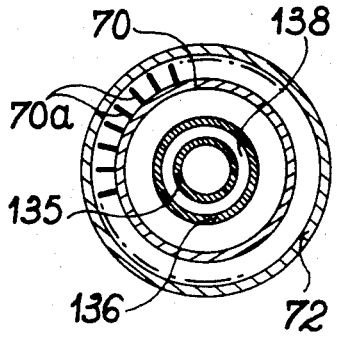

FIG. 3 a diagrammatic vertical sectional view of another embodiment of a steam generator according to the invention.

Figure 4:
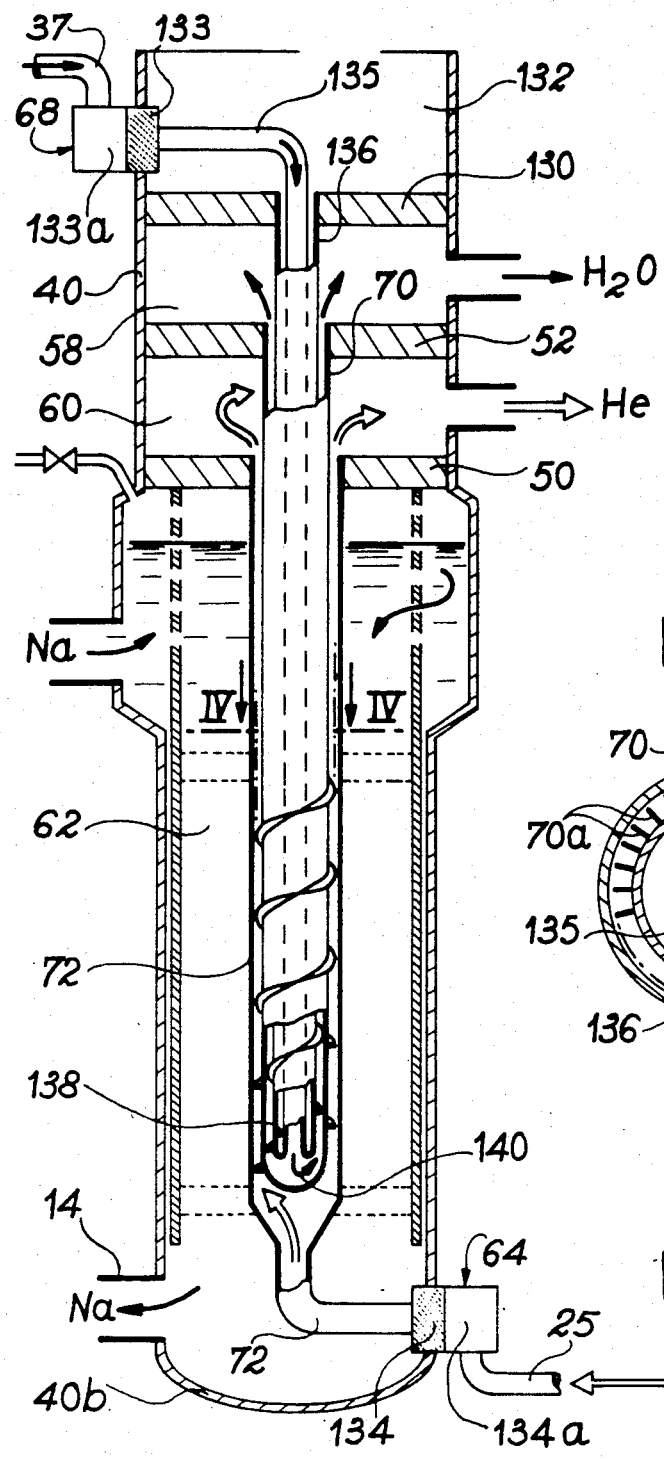

FIG. 4 a section along line IV—IV of FIG. 3 of a multi-walled tube of the bundle of tubes of the exchanger of FIG. 3.

Figure 5:
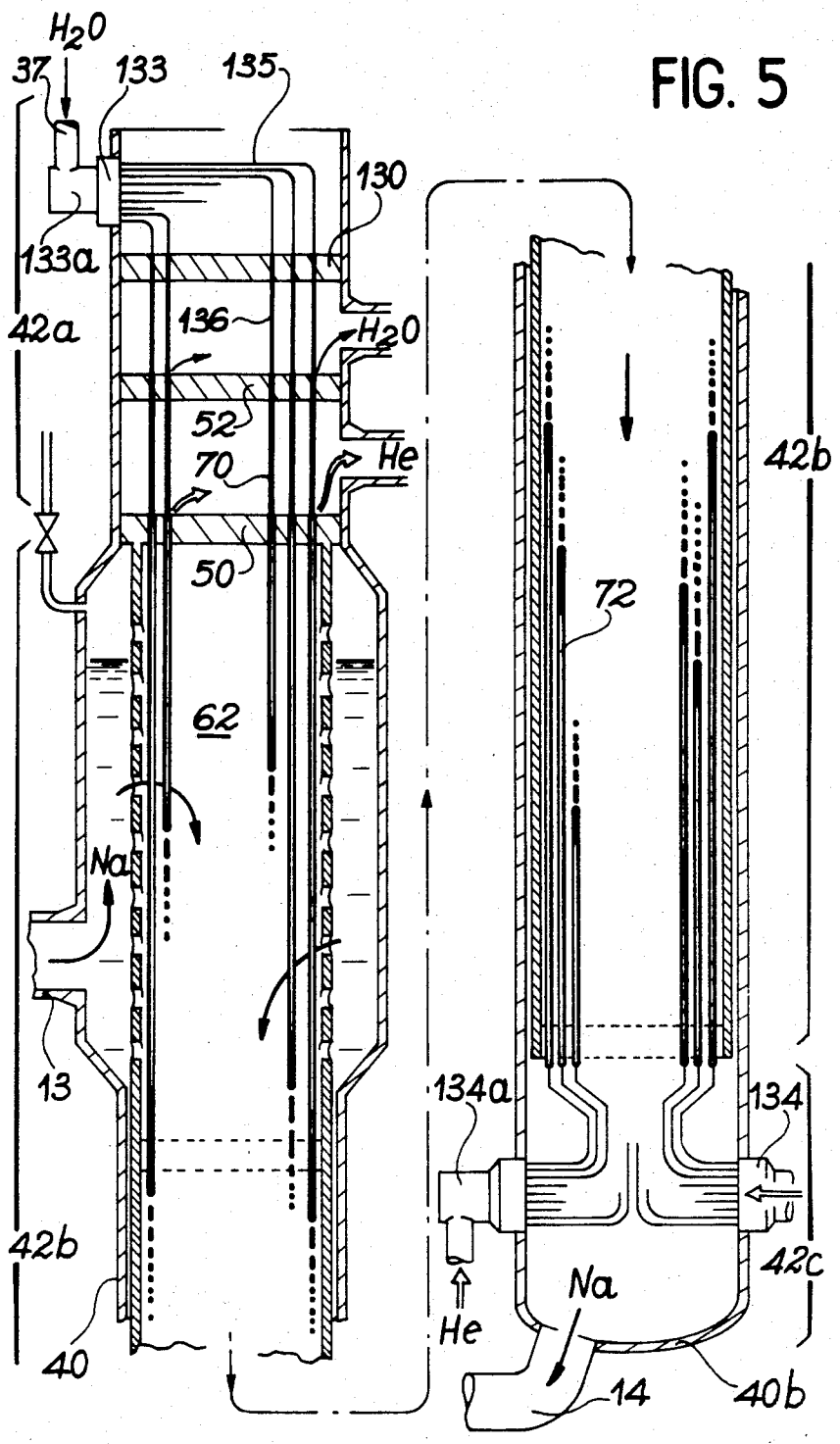

FIG. 5 a vertical sectional view of the embodiment of the steam generator shown in FIGS. 3 and 4.

Figure 6:
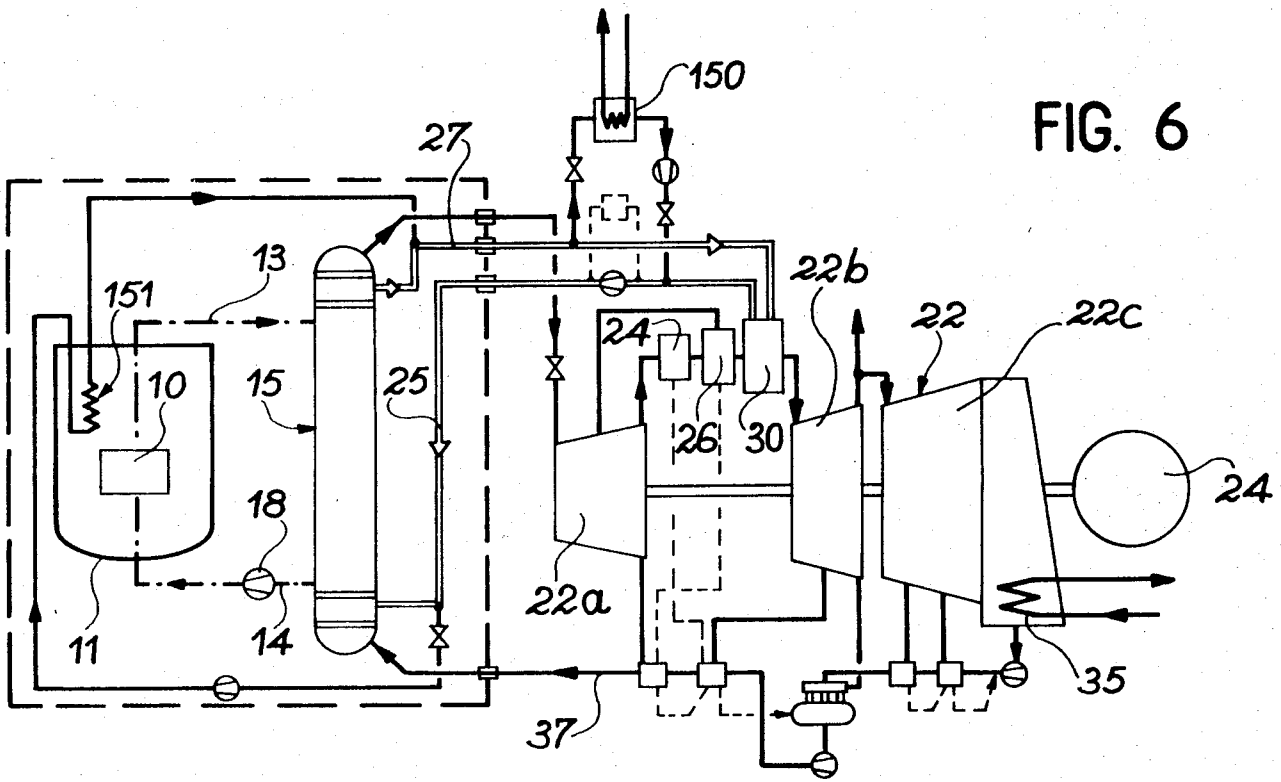

FIG. 6 a diagrammatic view showing a device for cooling the shutdown reactor using the advantages of the helium circuit.

FIG. 1 is an overall view of a nuclear installation having a nuclear reactor cooled by a liquid metal, e.g. sodium.

In a conventional manner, a nuclear boiler, such as e.g. that of the French Super Phénix reactor, has a primary sodium circuit comprising the reactor core and which transfers heat given off by the latter into intermediate exchangers—a secondary circuit, whose objective is to prevent any interaction between the radioactive primary sodium and the water/steam. This secondary circuit transfers the heat from the intermediate exchangers up to the steam generators. Finally, the boiler comprises a water/steam circuit emanating from the generators and supplying turbo-alternator sets.

In the case of the invention, there is no secondary sodium circuit. The primary sodium is directly introduced into the steam generator, where it transfers most of its heat (92–93%) to the water to be vaporized.

As shown in FIG. 1, core 10 is contained in a vessel 11 filled with a liquid metal, such as sodium. Vessel 11 is located in a concrete vessel well 12 forming part of the reactor building 16. Pumps 18 deliver primary sodium to the interior of the steam generators. In the represented embodiment, the steam generators 15 are distributed into four groups of several steam generators. Each of the generator groups is supplied by a primary sodium pump 18. Following its passage in the steam generators, the sodium returns to vessel 11 and then back into core 10, where the cycle recommences.

The water enters the steam generator 15 in the liquid state and leaves it in the vapour or steam state and then enters turbine 22 of the turboalternator set. As will be shown hereinafter, the water can be introduced either at the bottom of the generator, or in its upper part. Turbine 22 comprises a high pressure stage 22*a*, a medium pressure stage 22*b* and a low pressure stage 22*c* and drives an alternator 24. The steam is delivered by pipe 23 to the high pressure stage 22*a*. On leaving the latter, it is delivered to a drier 24*a* and then to a medium pressure resuperheater 26 by drawing off steam. According to a feature of the invention, the steam then passes through a second medium pressure resuperheater 30, which utilizes the heat of the intermediate fluid reheated in the steam generator. The steam is then passed to the medium pressure stage 22*b* of the turbine by pipe 32 and then to the low pressure stage 22*c* by pipe 34. The steam is condensed in condensor 35. In the represented embodiment, an atmospheric refrigerator 38 constitutes the cold source associated with condensor 35. The condensation water returns to the steam generator via pipe 37. It is pointed out that in this drawing, pipe 37 leads to the upper part of the generator, but it could also be connected to its base.

The installation also has a pressurized gas circuit with a low heat output (6 to 7% of the total output), preferably this gas is helium. This choice offers the advantages that helium is chemically neutral, neither reacts with sodium nor water, does not require the use of steels different from those currently used at high operating temperatures in a generator of this type, has good thermal and thermodynamic characteristics, its thermal conductivity is much higher than that of air or carbon dioxide gas, its specific heat is more than four times higher than that of the liquid sodium, whilst its specific gravity is 120 to 150 times lower. In addition, helium can be used on an industrial scale, its flow causes little stressing of structures and when used in an auxiliary exchanger located in the reactor vessel, has the advantage of not absorbing neutrons.

The helium is introduced into the bottom of the steam generator by pipe 25 and leaves from the upper part thereof. It is supplied to the medium pressure resuperheated 30 by pipe 27. In resuperheater 30, which is the external exchanger associated with generator 15, the helium gives off the relatively small quantity of heat which it has stored on passing through generator 15. The cooled helium returns to the steam generator.

FIG. 2 shows a steam generator 15 constructed according to the invention connected to a heat exchanger 30, which forms an apparatus supplying a heat complement to the steam cycle, resuperheating of medium pressure steam by means of the small intermediate helium circuit. The steam generator has an envelope 40 with a straight section, cylindrical longitudinal shape and with a vertical longitudinal axis X—X. The envelope is closed in its upper part by a convex end 40*a* and in its lower part by an end 40*b*. It is subdivided into three portions along the longitudinal axis, namely a heat exchange area between the first and second fluids, an admission-discharge area for these two fluids and a second admission-discharge area for the same fluids. The admission-discharge areas are located on either side of the exchanger area. The term admission-discharge area is understood to mean an area in which the fluids are introduced and/or discharged.

In the represented embodiment, reference 42*a* designates the first admission-discharge area located in the upper part of the generator. The central exchange area is designated by reference 42*b*. The secd admission-discharge area 42*c* is located at the bottom of the steam generator. In a generator like that of the invention using three fluids, there are three inlets and three outlets for these fluids, namely in all six supply or discharge pipes, which are distributed between the two admission-discharge areas 42*a* and 42*c*. In the embodiment of FIG. 2, the sodium is supplied by pipe 13 to the upper part of exchange area 42*b*. Its circulates from top to bottom in said exchange area before leaving in the lower part by pipe 14 to return to the core of the reactor.

The water is supplied by pipe 37 to the lower part of the steam generator. The steam is removed by pipe 23 in the upper part of the generator.

The intermediate gas, i.e. the helium, is supplied to the base of the steam generator into the admission-discharge area 42*c* by means of pipe 25. The helium circulates from bottom to top in countercurrent with respect to the heating fluid, which is sodium. It is removed from the steam generator into area 42*a*. It is supplied by pipe 27 to exchanger 30 in which it is cooled. The cooled helium is again introduced at the bottom of the steam generator after being recompressed by a blower 31.

The internal volume defined by envelope 40 is subdivided into several chambers by thick steel plates arranged perpendicularly to the longitudinal axis X—X of the envelope and which are axially spaced. These plates define separate internal volumes. These plates are provided with distributed holes in which tubes are fixed. In the represented embodiment, the generator has four plates, a first and a second tube plate being located in the upper part of the generator. The first tube plate 50 constitutes the limit between the central exchange area 42*b* and the upper admission-discharge area 42*a*. The second tube plate 52 is positioned above the first plate 50.

In the lower part of the generator is provided a third plate 54 and a fourth plate 56. Plate 54 constitutes the limit between the central exchange area 42*b* and the admission-discharge area 42*c*. Plate 56 is located beneath plate 54. Plate 52 defines with the upper end 40*a* of envelope 40 an internal volume 58. The axially spaced plates 50 and 52 define between them a volume 60. Plates 50 and 54 define between them the volume 62 constituting the actual exchange area. Plates 54 and 56 define a volume 64 between them. Finally, plate 56 defines a volume 68 with the lower end of the envelope.

The steam generator also has a bundle of tubes distributed in accordance with its cross-section. More specifically, the tube bundle is constituted by two series of tubes, a series of internal tubes and a series of external tubes arranged coaxially. The upper end of each internal tube 70 is fixed to plate 52. Its lower end is fixed to the tube plate 56. The upper end of each external tube 72 is fixed to tube plate 50. The lower end of each external tube 72 is fixed to tube plate 54.

The fact that the generator tubes are straight leads to differential expansion problems between the bundle of tubes and the external envelope of the generator. These problems are solved on the one hand by the presence of a flexibility zone 70*a* on internal tube 70 and which is located in chamber 64. In addition, an expansion bellows 74 is provided on envelope 40, in order to compensate the expansion differences between the bundle of external tubes and the envelope.

The water is introduced into chamber 68, which forms a water tank in the lower part of the generator by pipe 37. It enters tube 70, in which it circulates from bottom to top (arrow 76) and leaves the tube 70 (arrow 78) in the form of steam and passes into chamber 58, which forms the discharge collector.

The intermediate fluid or helium is introduced into admission chamber 64. The helium enters the annular space between internal tube 70 and external tube 72. Advantageously, and in an exemplified manner, a wire 80 is helically wound around the internal tube 70. The function of the wire is to centre the internal tube relative to the external tube. Moreover, the helical effect resulting therefrom lengthens the passage of the intermediate fluid, increases turbulence and consequently improves the heat exchange between the gas and respectively the sodium and the water/steam. This device can be replaced or complemented by blades on the outer surface of the internal tube. The hot helium is collected in the discharge chamber 60 before being passed to heat exchanger 30.

The hot sodium is supplied by pipe 13 to the upper part of exchange area 42*b*. It is distributed around the internal ferrule or shroud 82 by means of an annular chamber 84. It passes beyond ferrule 82 in its upper part and circulates from top to bottom between the external tubes 72. In the lower part of the exchange area 42*b*, the sodium passes beneath ferrule 82 and is collected in annular space 86 before being removed from the generator by pipe 14.

Heat exchanger 30 is of a conventional nature and has an external envelope 100 with an upper convex end 102 and a lower convex end 104. Thus, within the envelope 100 are located an upper tube plate 106 and a lower tube plate 108. Tube plate 106 defines with end 102 an admission chamber 110 for the helium. Between the tube plate 106 and tube plate 108 is defined a heat exchange area between the helium and the medium pressure steam from the turbine. With end 104, tube plate 108 defines a discharge chamber 114 for the helium. Within the envelope 100 between plates 106 and 108 is provided a tube bundle 116. The tubes are fixed by one end to plate 106 and by the other to plate 108. They are regularly distributed and have a flexibility zone 118 for compensating differential expansions. The helium enters the tubes 116 (arrow 120), passes through them from top to bottom and leaves from the lower part of the exchanger (arrow 112) and passes into discharge chamber 114. The steam is introduced into the lower part of the exchange area by pipe 124. It circulates from bottom to top between the tubes and passes out in the upper part of the exchange area via pipe 126. This description of exchanger 30 is only given in an exemplified manner, because numerous modifications can be made thereto.

FIG. 5 is a vertical sectional view of a second embodiment of a steam generator according to the invention and, in FIGS. 3 and 4, a diagrammatic view giving the principle of an elementary tubular cell. FIG. 4 is a sectional view along line IV—IV of FIG. 3 of said tube shown on an even larger scale.

The internal volume defined by envelope 40 is subdivided into several chambers by thick steel plates arranged perpendicularly to the longitudinal axis XX of the envelope and which are axially spaced. These plates define volumes separated from one another and are provided with distributed holes, in which are fixed tubes.

In the case of the embodiment of FIGS. 3 to 5, the generator comprises three plates arranged in accordance with a cross-section of the envelope. These plates are respectively the first plate 50, to which is fixed one end of the external tubes 72, the second plate 52 to which is fixed one end of the internal tubes 70 and a third plate 130 which is positioned axially further from the central area than plates 50 and 52. Plate 130 is the upper end of the generator. It is surmounted by an extension of cylindrical envelope 40. Plates 130 and 52 define between them a chamber 48 for the discharge of the steam. Plates 50 and 52 define between them a chamber 60 for the discharge of the helium. The first plate 50 defines with the convex lower end 40*b* of the envelope, the volume 62 constituting the exchange area of the steam generator.

The steam generator also has one or more small tube plates 133. These plates have a much smaller diameter than plates 50, 52 or 130. In practice, there are several identical plates 133. The plane of these plates is parallel to the longitudinal axis XX of the steam generator. They are located in the upper part thereof on the side wall of envelope 40. A water tank 133*a* with its supply pipe 37 is fixed to each plate 133.

The generator also has tube plates 134, which have a much smaller diameter than plates 50, 52 or 130. They are located in the lower part of the generator and are distributed over the wall of envelope 40. A helium tank 134*a* with its helium supply pipe 25 is fixed to each plate 134.

In this embodiment, the admission-discharge area 42*a* located in the upper part of the generator extends substantially along its longitudinal axis up to the first tube plate 50. The water is introduced into this area. The intermediate fluid, namely helium and steam, are removed from said area. The central exchange area 42*b* extends virtually to the lower end 40*b* of the exchanger. The primary sodium is introduced into the upper part of said area. The lower admission-discharge area 42*c* has helium introduction by pipe 25 and primary sodium discharge by pipe 14.

The special feature of this embodiment having so-called bayonet tubes is based on the means making it possible to bring from the top of the steam generator the supply water to the lower end of the exchange area. Whereas in the embodiment of FIG. 2, these means are constituted by tube plate 56 and the water tank 68 located at the bottom of the steam generator, in the embodiment of FIGS. 3 to 5, the water is supplied from the upper part of the steam generator to the lower part of each inner tube by a first tube 135 surrounded by a second tube 136. Each tube 135 has first and second ends. The first end is fixed to the tube plate 133 located in the lateral upper part of the generator envelope 40. Each tube 136 has a first and a second end, the first end being fixed to the tube plate 130, whilst the second end is located in the lower part of the steam generator and is sealingly connected to the second end of the tube 135 which it surrounds. The walls of tubes 135 and 136 define an annular space 138, whose upper part issues into the ambient air above plate 130. This annular space is filled with a stagnant gas, which constitutes an effective thermal insulation.

FIG. 4 is a larger scale view than FIG. 3 in section of a modular assembly of multiple tubes of the dipping bayonent type shown in FIG. 3. This assembly comprises four concentric tubes, respectively from the inside to the outside, the first tube 135, the second tube 136, the internal tube 70 and the external tube 72. The double tube constituted by the firsst and second tubes 135, 136 expands freely at its two ends. It is centered in the steam jet by a not shown helical wire or some other appropriate means. The internal tube can have blades 70*a*, which serve to increase the heat exchange between the intermediate gas and the tube wall. The presence of blades makes it possible to shorten the length of exchange area 42*a*. Moreover, the diameter of internal tube 70 is greater, so that the exchange surface is increased, which provides another factor making it possible to reduce the length of the exchange area.

FIG. 5 shows a construction of the exchanger according to the principle described with reference to FIGS. 3 and 4, but which is closer to the real construction. Whereas in FIG. 3 only a single multi-walled dipping tube is shown on a larger scale in order to distinguish the four tubes forming it, FIG. 5 shows several of these tubes constituting the tube bundle of the exchanger. The tube bundle 136 is fixed by its upper part to the tube plate 130. The tube bundle 70 is fixed by its upper part to tube plate 52. The bundle of external tubes 72 is fixed on its upper part to tube plate 50 and by its lower part to the small lateral tube plates 134. Two of these plates are shown in FIG. 5 but, in practice, there can be more of these.

In the exchanger embodiment of FIGS. 3 to 5, the water enters the upper part of the exchanger, traverses the first tube in a vertical direction from top to bottom and passes round the end of the first and second tubes (arrow 140 in FIG. 3). The steam generation jet is constituted by the annular space between tubes 70 and 72, vaporization taking place in the upward direction. As in the first embodiment, steam discharge takes place through the top of the generator.

The layer of air separating the water intake tube and the vaporization jet acts as a thermal insulator. The sodium circulates downwards and external of the multi-walled tubes, whilst the helium circulates upwards.

The advantages of this embodiment are that it permits a better adjustment between the circulation and heat exchange conditions relating both to the water/steam and the helium on the one hand and the helium and sodium on the other. It also makes it possible to reduce the exchange length by increasing the diameters of the sodium-helium tubes and particularly the helium-water tubes, which reduces the exchange length. This length is further reduced by the presence of blades. The water supply tubes, namely tubes 135 can freely and individually expand. The internal water/steam tubes 70 fixed by one of its ends to the tube plate 52 and closed at its other end can expand freely. The external tubes 72, which are individually connected to tube plates 134 by elbows can also freely and individually expand. This prevents differential thermal expansion stresses between each individual tube and between the tube bundle and the outer envelope of the steam generator. As a result and bearing in mind the thermal exchange properties of liquid sodium, it is possible to adopt a longitudinal and therefore simple flow, which does not disturb the liquid sodium. Finally, the access possibilities to the ends of the water and helium supply tubes are improved as a result of the configuration of the lateral helium and water tanks.

The use of the chemically neutral gas, i.e. helium can extend to the cooling of the shutdown reactor, i.e. for cooling the primary sodium when the main pumps are no longer operating. For example, the intermediate helium circuit of the steam generator in the invention is connected in the manner shown in FIG. 6 to an exchanger 150 dimensioned for the cooling of the shutdown reactor and bypassed on the pipe 27 for discharging the intermediate fluid from the generator 15 and on the pipe 25 for supplying intermediate fluid to the generator. Unlike in this solution, which is based on the standby use of steam generators of the main loops, it is also possible to envisage bypassing of the intermediate helium circuit connected to a heat exchanger 151 placed in the reactor vessel. These two solutions can also be used jointly and other solutions can also be envisaged.

The use of helium offers numerous advantages for this function. It is chemically neutral, leads to moderate heat exchanger coefficients and consequently to less severe thermal shocks and transients. It is not activated under neutron radiation and is easily purified. The final heat transfer can take place underwater or on air, but the exchanger will be more compact in the first case.

I claim:

1. A steam generator installation comprising:

a steam generator envelope, of generally elongated shape;

a liquid metal inlet and a liquid metal outlet being provided in the envelope for a liquid metal, said inlet and outlet being spaced apart to define a heat exchange area between them;

a bundle of tubular elements enclosed within said envelope and located substantially within said heat exchange area, each tubular element being comprised of at least an external tube and an internal tube positioned substantially coaxially within said external tube, with a clearance for defining a passage for a chemically neutral pressurized gas;

at least a water admission chamber for water to be vaporized and a discharge chamber for water steam produced by vaporization of said water;

at least one pressurized gas admission chamber and a pressurized gas discharge chamber for said pressurized gas, and located on one side and on the other side of said heat exchange area respectively, each of said external tubes having an inlet end connected to said pressurized gas admission chamber, and an outlet end connected to said pressurized gas discharge chamber; each of said internal tubes having an inlet end connected to said water admission chamber, and an outlet end connected to said steam discharge chamber; said installation further comprising a means for including forced convection in the thermal exchange between said liquid metal and said pressurized gas and between said pressurized gas and said water, said means including a heat exchanger means for controlling the temperature of said pressurized gas which includes a a heat exchanger envelope, a pressurized gas admission chamber, and a pressurized gas discharge chamber in said heat exchanger envelope, a heat exchange fluid inlet, and a heat exchange fluid outlet being provided in said heat exchange envelope, said gas being cooled by heat exchange fluid, a first pipe for connecting said pressurized gas discharge chamber of said steam generator to said pressurized gas admission chamber of said heat exchanger, and a second pipe for connecting said pressurized gas discharge chamber of said heat exchanger to said pressurized gas admission chamber of said steam generator, and a circulating pump means for circulating and recirculating said pressurized gas within said passage between said internal and external tubes, thus making possible the effecient thermal exchange between said liquid metal and said water.

2. A steam generator according to claim 1, wherein the pressurized gas is helium.

3. A steam generator according to claim 1, wherein the pressurized gas is a compatible pressurized gaseous mixture.

4. A steam generator according to claim 1, wherein the heat exchanger is constituted by an apparatus supplying a heat complement to the steam cycle.

5. A steam generator according to claim 4, wherein the heat exchanger is a steam resuperheater for a steam turbine.

6. A steam generator according to claim 1, wherein the pressurized gas admission chamber is defined by first and second axially spaced tube plates located on said one side of said heat exchange area, the external tubes being connected to the first tube plate, the internal tubes being connected to the second tube plate and there is a gas supply pipe connected to the steam generator envelope between the first and second tube plates.

7. A steam generator according to claim 1, wherein it comprises a first and second axially spaced tube plates located on said other side of said heat exchange area;

a third tube plate having a greater axial spacing from the heat exchange area than the second tube plate, the third tube plate and the second tube plate defining said steam discharge chamber;

a plurality of elementary tubular cells each having first and second tubes located within each internal tube, the first tube being arranged within the second tube, one end of the first tube being connected to a small lateral tube plate which is integral with a water tank, one end of the second tube being connected to the third tube plate, the second ends of the first and second tubes being sealingly connected in such a way as to define an annular space containing stagnant ambient air;

each internal tube being sealed at its lower end;

each external tube being connected to a small tube plate, which is integral with a helium tank.

8. A steam generator according to claim 7, wherein the internal tube is provided with blades.

9. A steam generator according to claim 1, wherein a heat exchanger for cooling a reactor when shut down is connected in bypass manner to the first pipe for discharging pressurized gas from the steam generator and to the second pipe for the supply of pressurized gas to the steam generator.

10. A steam generator according to claim 1, wherein a heat exchanger placed in a vessel of a reactor for cooling the reactor when shut down is connected in bypass manner to the first pipe for discharging the pressurized gas out of the steam generator and to the second pipe for supplying pressurized gas to the steam generator.

* * * * *